US009636736B2

(12) United States Patent
Zak et al.

(10) Patent No.: US 9,636,736 B2
(45) Date of Patent: May 2, 2017

(54) METHOD AND MOULD ARRANGEMENT FOR EXPLOSION FORMING

(71) Applicants: Alexander Zak, Moedling (AT); Seetarama S. Kotagiri, Rochester Hills, MI (US); Andreas Stranz, Reichenau (AT); Philipp Stoeger, Wildenduernbach (AT)

(72) Inventors: Alexander Zak, Moedling (AT); Seetarama S. Kotagiri, Rochester Hills, MI (US); Andreas Stranz, Reichenau (AT); Philipp Stoeger, Wildenduernbach (AT)

(73) Assignee: Cosma Engineering Europe AG

( * ) Notice: Subject to any disclaimer, the term of this patent is extended or adjusted under 35 U.S.C. 154(b) by 291 days.

(21) Appl. No.: 14/502,173

(22) Filed: Sep. 30, 2014

(65) Prior Publication Data

US 2016/0089709 A1 Mar. 31, 2016

(51) Int. Cl.

| | |
|---|---|
| ***B21D 26/08*** | (2006.01) |
| ***B21D 39/04*** | (2006.01) |
| ***B21D 26/14*** | (2006.01) |
| ***B21D 26/12*** | (2006.01) |

(52) U.S. Cl.

CPC ..... *B21D 26/08* (2013.01); *B21D 26/12* (2013.01); *B21D 26/14* (2013.01); *B21D 39/042* (2013.01)

(58) Field of Classification Search

CPC ..... B21D 26/08; B21D 39/042; B21D 26/14; B21D 26/12; B23K 20/085; F42D 3/00; B01J 3/08; B21C 37/047; F02B 1/12; F02P 23/04; F02P 7/0632; H01T 13/08

USPC ..... 72/56, 706

See application file for complete search history.

(56) References Cited

U.S. PATENT DOCUMENTS

| | | | | |
|---|---|---|---|---|
| 2,983,242 A * | 5/1961 | Cole | ..... | B21D 26/08 29/421.2 |
| 3,188,844 A * | 6/1965 | Schwinghamer | ..... | B21D 26/10 29/421.2 |
| 3,195,334 A * | 7/1965 | Filler | ..... | B21D 26/08 29/421.2 |
| 4,187,709 A * | 2/1980 | Legate | ..... | B21D 26/08 72/56 |

(Continued)

FOREIGN PATENT DOCUMENTS

| | | |
|---|---|---|
| DE | 102007007330 | * 2/2007 |
| GB | 2047147 | * 11/1980 |
| WO | 2006/128519 | * 12/2006 |

*Primary Examiner* — David B Jones

(74) *Attorney, Agent, or Firm* — Dickinson Wright PLLC

(57) ABSTRACT

The invention is intended to improve a method for explosive forming of a workpiece by means of gas explosion, in which the workpiece is arranged in a intake area of a moulding tool, wherein the intake area is at least partially filled with liquid and the explosion is triggered by ignition of an explosive gas mixture, to the effect that the method is suitable and simplified for mass production. This object is solved by a method for explosive forming of a workpiece by means of gas explosion, in which the workpiece is arranged in a intake area of a moulding tool, wherein the intake area is at least partially filled with liquid and the explosion is triggered by means of ignition of an explosive gas mixture, in which the explosive gas mixture is provided at least partially above the surface of the liquid before the ignition.

15 Claims, 5 Drawing Sheets

(56) References Cited

U.S. PATENT DOCUMENTS

| | | | | | |
|---|---|---|---|---|---|
| 4,856,311 | A * | 8/1989 | Conaway | B30B 11/001 | 219/651 |
| 5,220,727 | A * | 6/1993 | Hochstein | B21D 26/08 | 102/293 |
| 5,339,666 | A * | 8/1994 | Suzuki | B23K 20/08 | 29/421.2 |
| 8,047,036 | B2 * | 11/2011 | Trubert | B21D 26/08 | 72/56 |
| 8,250,892 | B2 * | 8/2012 | Zak | B21D 26/08 | 29/421.2 |
| 8,443,641 | B2 * | 5/2013 | Zak | B21D 26/08 | 72/56 |
| 8,713,982 | B2 * | 5/2014 | Stranz | B21D 26/08 | 148/515 |
| 8,875,553 | B2 * | 11/2014 | Zak | B21D 26/08 | 72/54 |
| 2016/0089709 | A1 * | 3/2016 | Zak | B21D 26/08 | 72/56 |

* cited by examiner

METHOD AND MOULD ARRANGEMENT FOR EXPLOSION FORMING

CROSS-REFERENCE TO RELATED APPLICATIONS

This is a Divisional Application which claims priority to U.S. National Stage Patent Application Ser. No. 12/447,727 filed Mar. 30, 2010 entitled "Method And Mould Arrangement For Explosive Forming" which claims priority from International Ser. No. PCT/EP2007/010966 filed Dec. 13, 2007, which claims priority from German Patent No. 10 2007 007 330 filed on Feb. 14, 2007, entitled "Verfahren und Werkzeuganordnung zum Explosionsumformen" (Method and Tool Arrangement for Explosive Forming), the disclosures of which are incorporated herein by reference for all purposes.

FIELD OF THE INVENTION

The invention relates to a method and a tool arrangement for explosive forming.

BACKGROUND OF THE INVENTION

In a method of this kind known from CH 409 831, the workpiece to be formed, e.g., a tube, is inserted into a form and filled with water. A device that comprises a multiple number of electrodes and that is intended for generating and igniting a detonating gas is packed in an elastic container, e.g., a plastic bag. This is placed inside the workpiece, sunk so deeply in the water that the bag lies completely below the surface of the water. By activating two electrodes, detonating gas is generated under water, and this gas collects in the surrounding bag. By using a sparking plug or a heating wire to ignite the detonating gas produced in the bag, a pressure wave is produced in the water, and this pressure wave presses the workpiece into the form. This method is, however, costly and time-consuming.

SUMMARY OF THE INVENTION

The object of the present invention is to improve a method and a tool arrangement for explosive forming of the kind mentioned at the beginning to the effect that the method and the tool arrangement are simplified and suitable for mass production.

The provision of the gas mixture at least partially above the surface of the liquid guarantees simple and rapid feeding of the gas mixture. Although the gas mixture here is arranged above the surface of the liquid, meaning at a relatively far distance from the workpiece to be formed, the inventive method nevertheless allows a good forming result to be obtained. The explosion of the gas mixture and consequently the formation of a detonation front here initially take place above the surface of the liquid. It has, however, been seen that the transmission of power or energy across the gas-liquid phase interface is sufficiently good in order to produce a good forming result. Because the intake area is partially filled with liquid, which serves as the pressure transmission medium, it is possible to reduce the quantity of gas required. In contrast to explosive forming without liquid, burns are largely avoided on the workpiece. As a result of the rapid production cycles in today's production processes, the moulding tool reaches high temperatures relatively quickly. The liquid located in the intake area can consequently serve not only as a pressure transmission medium, but also as a cooling agent.

In a favourable embodiment of the invention, the gas mixture can be directly adjacent to the surface of the liquid. Although in this case, the detonation front hits the surface of the liquid without hindrance, the direct contact of the gas at the surface of the liquid results in good transmission of power across the gas-liquid phase interface.

The intake area can advantageously be filled with liquid via a valve. This guarantees good control of the filling process and precise dosing of the quantity of liquid.

In a variant of the invention, the gas mixture can be at least partially routed in through the liquid. In this way, depending on the gas mixture, higher pressures can be reached with an equal amount of gas. It has been seen that, as a result of being routed in through the liquid, such as water, for example, the gas is in a state in which ignition of the gas leads to a considerably higher explosion pressure. As a result, the forming pressure that acts on the workpiece is also higher.

In a favourable embodiment of the invention, the intake area can extend at least partially through a pre-formed workpiece cavity in which the detonation front propagates. The detonation front that propagates in the interior of the workpiece can consequently properly form the wall of the workpiece. This allows proper forming of, for example, tubular workpieces.

In a further embodiment of the invention, the workpiece can be filled with liquid in a workpiece holding area in which the workpiece is held in the moulding tool. In this way, the ends of the workpiece that are held in the tool arrangement are also protected from burns. Interfaces or contact areas are present in the workpiece holding area, e.g., between the workpiece and the moulding tool, whereby these interfaces or contact areas must be tight during the explosive forming process. By covering these interface areas with liquid, the design layout of these areas can be simplified. A liquid-tight interface is easier and more economical to produce than is, for example, a gas-tight one.

The entire workpiece cavity can advantageously be completely filled with liquid. In this way, large areas of the workpiece are protected against burns with simultaneously good transmission of power.

A remaining liquid-free workpiece cavity can favourably be at least partially filled with the explosive gas mixture. This guarantees simple and quick filling with the gas mixture.

In an advantageous embodiment of the invention, a remaining liquid-free cavity that is spaced at some distance from the introduced workpiece can be at least partially filled with the explosive gas mixture. In this way, even if the intake area or the workpiece cavity is filled completely with liquid, a sufficiently large quantity of gas can be incorporated in order to guarantee a good explosion and propagation of the detonation front.

In a variant of the invention, the intake area can be filled with liquid by means of submerging the workpiece in a liquid bath. Liquid can consequently be filled into the workpiece, for example, even before the workpiece is introduced into the intake area of the moulding tool. This simple manner of filling guarantees good production cycles. During the production process, the liquid bath can simultaneously serve as a buffer for workpieces that are to undergo further processing.

The ratio of explosive gas to liquid can advantageously amount to roughly 1:10 to 1:20, preferably 1:2 to 1:15, and particularly 1:3 to 1:10. This ratio guarantees an explosive force that is sufficiently large for the forming, as well as good propagation of the detonation front, even beyond the phase interface.

The ignition of the gas mixture can advantageously take place outside of the workpiece cavity. In this way, the liquid level in the intake area can be adjusted to the production requirements. Maximum liquid levels, such as a complete covering of the workpiece with fluid, for example, are also possible in this way.

The object mentioned at the beginning is furthermore solved on the device side by means of a tool arrangement.

The arrangement of the explosive gas mixture at least partially above the surface of the liquid allows simple and rapid filling. At the same time, good transmission of the explosive force and the detonation front across the phase interface are possible. Although the gas mixture here is arranged above the surface of the water, a good forming result is reached.

The gas mixture can advantageously be directly adjacent to the surface of the liquid. The direct and unhindered contact of the gas mixture with the surface of the liquid guarantees good power transmission.

In a further embodiment of the invention, the intake area can be filled with liquid via a valve. This allows good control of the filling process and good dosing of the quantity of liquid.

In a variant of the invention, a gas connection can be provided below the surface of the liquid. In this way, the gas mixture can be routed into the intake area through the liquid. This allows higher forming pressures with the same quantity of gas, depending on the gas mixture.

The intake area can favourably extend at least partially through a pre-formed workpiece cavity. In this way, the detonation front can also propagate in the interior of the workpiece.

In a further embodiment of the invention, the workpiece can be filled with liquid in a workpiece holding area at which the workpiece is held in the moulding tool. In this way, the ends of the workpiece that are held in the moulding tool are also protected from burns. At the same time, this arrangement allows a reduction in the design requirements regarding sealing of the interfaces located in the tool holding area, such as the workpiece-moulding tool interface, for example. The design of liquid-tight interfaces is easier to implement than, e.g., gas-tight interfaces.

The entire workpiece cavity can advantageously be completely filled with liquid. In this way, a large portion of the workpiece surface is located below the liquid and so is protected from burns.

In an advantageous embodiment of the invention, a remaining liquid-free workpiece cavity can be at least partially filled with the explosive gas mixture. This guarantees simple filling with the gas mixture.

A remaining liquid-free cavity that is spaced at some distance from the introduced workpiece can favourably be at least partially filled with the explosive gas mixture. This cavity guarantees the admission of a sufficiently large quantity of gas and consequently a good explosion and propagation of the detonation front, regardless of the liquid level in the intake area.

In a variant of the invention, an ignition device can be arranged outside of the workpiece cavity. The ignition of the gas mixture can consequently take place independently of the liquid level in the interior of the workpiece.

BRIEF DESCRIPTION OF THE DRAWINGS

In the following, embodiments of the invention are explained using the following drawing and are shown as.

DETAILED DESCRIPTION OF THE PREFERRED EMBODIMENTS

Figure 1:
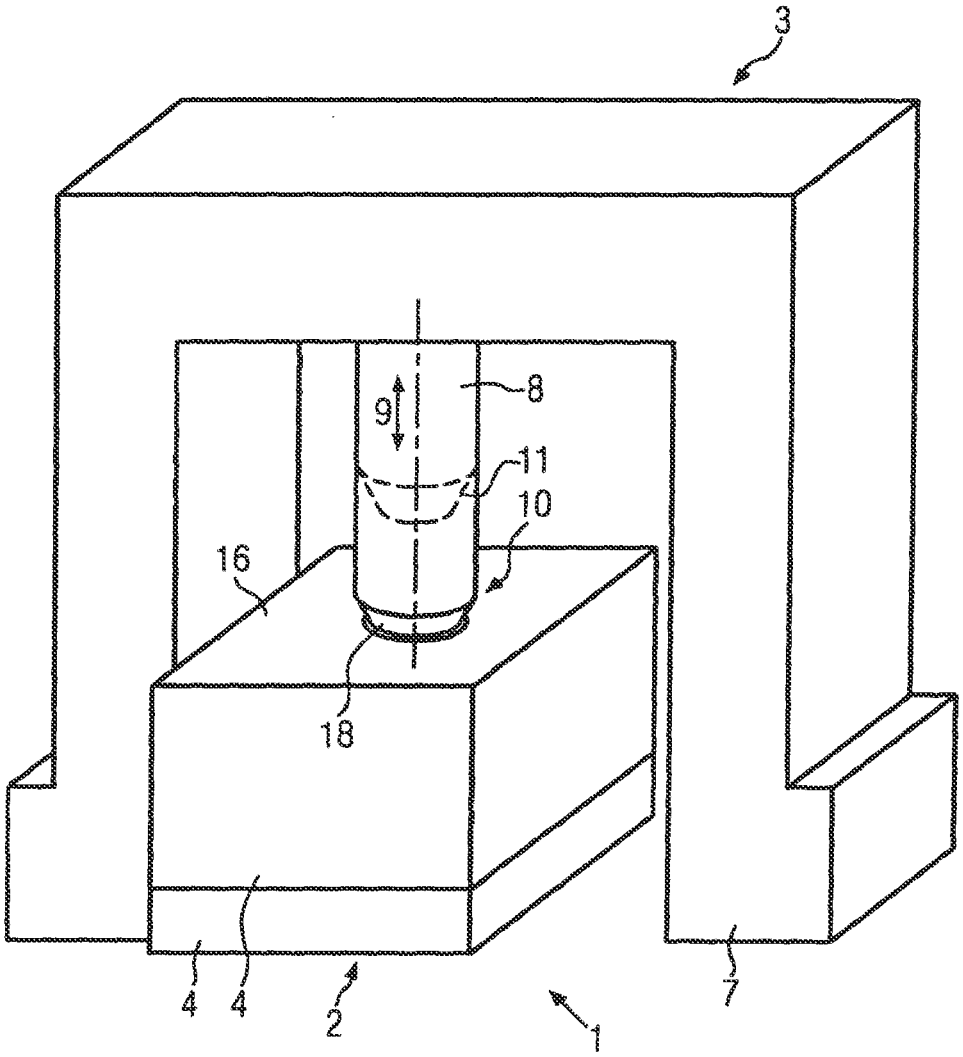
FIG. 1 a perspective view of a tool arrangement according to the invention in accordance with a first embodiment of the invention.

FIG. 1 shows a perspective view of a tool arrangement 1 according to the invention in accordance with a first embodiment of the invention. The tool arrangement 1 in this embodiment comprises a moulding tool 2 and an ignition aggregate 3.

Figure 3:
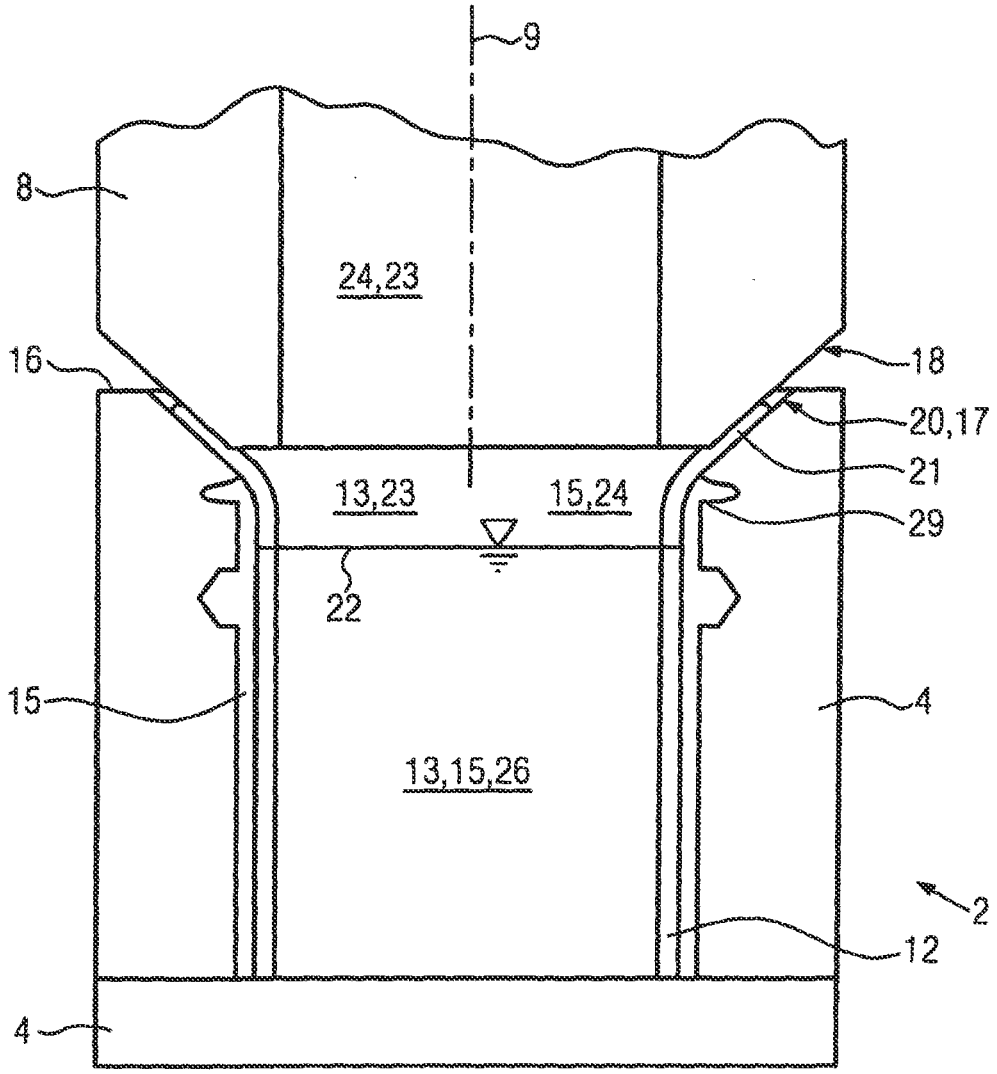
FIG. 3 a cut through the tool according to the invention, with inserted workpiece and liquid filling.
Figure 4:
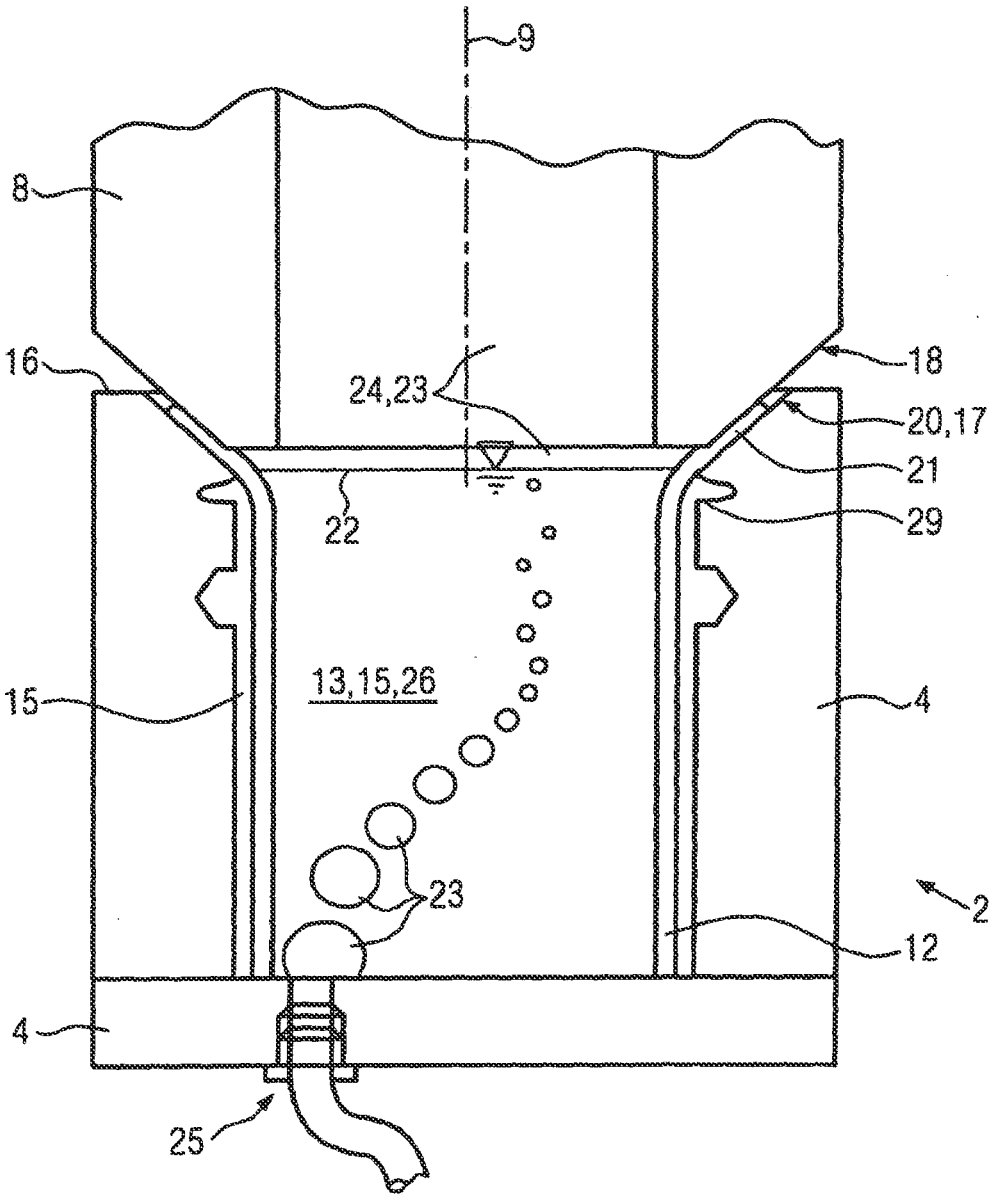
FIG. 4 a cut through the tool arrangement according to the invention, with inserted workpiece and changed liquid level in accordance with a second embodiment of the invention.
Figure 5:
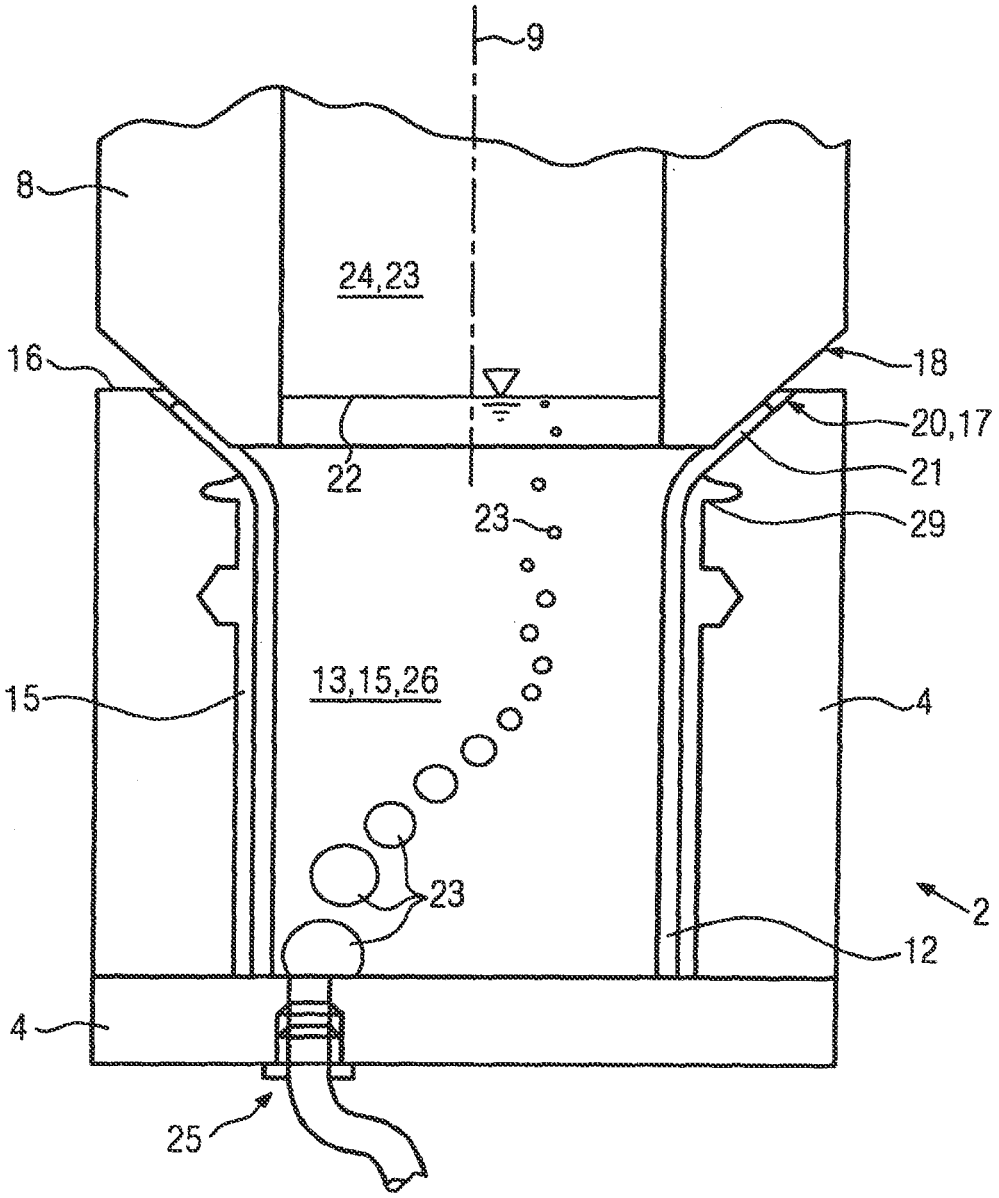
FIG. 5 the tool arrangement according to the invention from FIG. 4, with a changed liquid level.

The moulding tool 2 is formed in a multiple number of pieces. It consists of a multiple number of mould halves 4, which can be assembled into the moulding tool 2. When closed, which means when all mould tool halves 4 are assembled together, a mould cavity 14 results in the interior of the moulding tool 2, whereby the contour of this mould cavity 14 produces the later shape of the completed workpiece. In addition, cutting or separating edges 29 and matrices of holes 30 can be provided in the contour of the moulding tool 2, in order to simultaneously cut the workpiece during the explosive forming, as shown in FIGS. 3 to 5. The mould cavity 14 simultaneously forms an intake area 15 of the moulding tool 2. According to the invention, the intake area 15 is at least partially filled with a liquid, as will be explained later with reference to FIGS. 3 to 5.

The moulding tool 2 can also be arranged in a press 5 that holds the moulding tool 2 closed. The individual moulding tool halves 4 can then, for example, be pressed against one another by one or more dies of the press.

The ignition aggregate 3 in this embodiment has a holder 7 and an ignition tube 8. On its front end 18 facing the moulding tool 2, the ignition tube 8 tapers conically and is held in the holder 7 in such a way that it can be moved at least in its longitudinal direction 9. In this way, it can be moved between a working position 10, in which the ignition tube 8 abuts a workpiece 12 located in the moulding tool 2 or abuts the moulding tool 2, and a parked position 11, in which the ignition tube 8 is spaced at a distance from the moulding tool 2 and which here is indicated by a dashed line. In other embodiments of the invention, the ignition tube 8 can, however, also have a multiple number of degrees of freedom and, e.g., also be movable, for example, at a right angle to its longitudinal direction 9.

Figure 2:
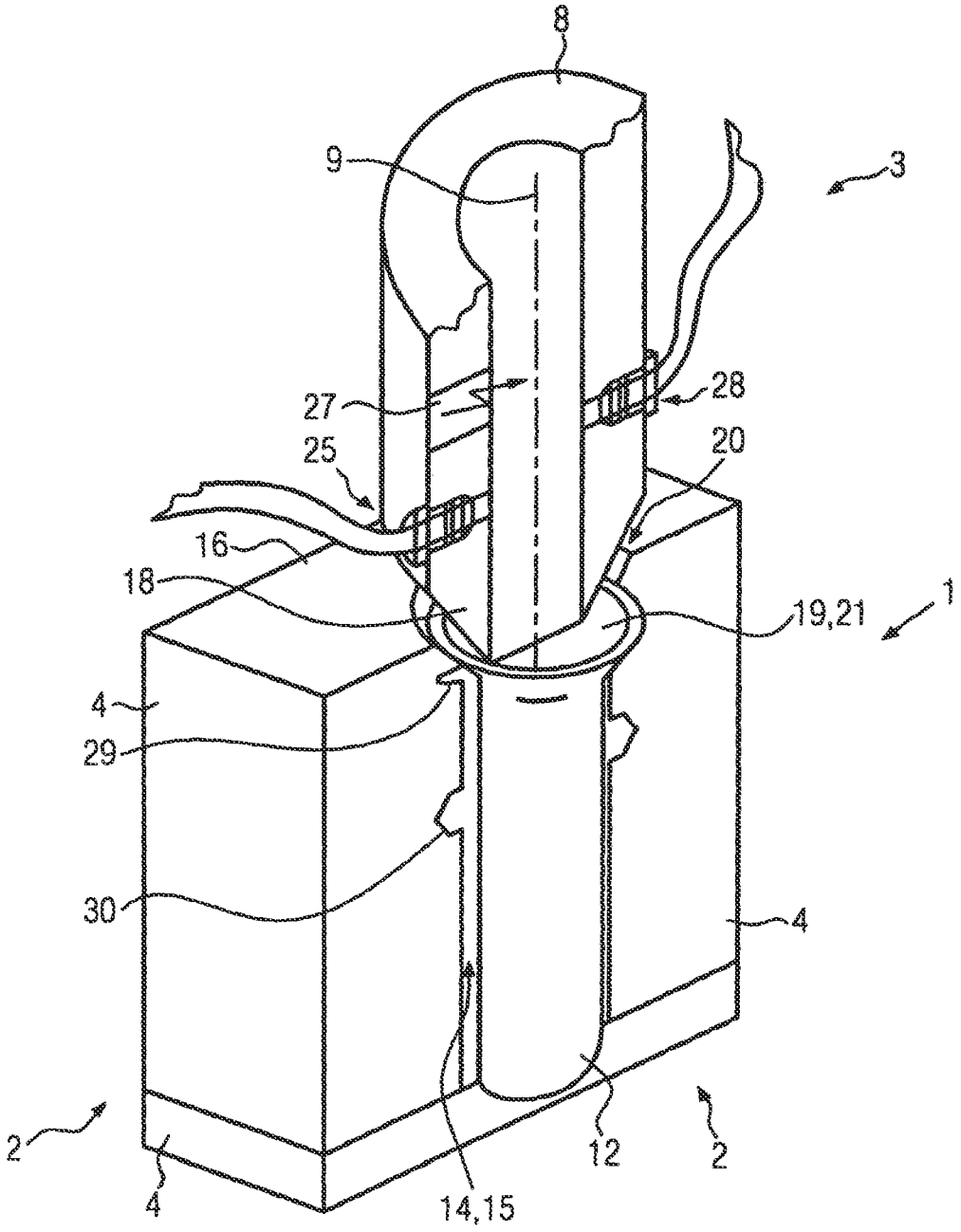
FIG. 2 an enlarged perspective sectional view through the tool arrangement according to the invention, with an inserted workpiece.

FIG. 2 shows a perspective sectional view through the tool arrangement 1 according to the invention, with an inserted workpiece. The reference numbers used in FIG. 2 indicate the same parts as in FIG. 1, so that reference is made to the description of FIG. 1 in this regard.

A workpiece 12 is inserted into the intake area 15 of the moulding tool 2. In this embodiment, the workpiece 12 is, for example, tube-shaped and has a pre-formed workpiece cavity 13 in its interior. The contour of the moulding tool 2, to which the workpiece 12 is adapted by means of forming, is also, for example, tube-shaped here.

The moulding tool 2, on its side 16 facing the ignition tube 8, has an opening 17 which is connected to the intake area 15 in the interior of the moulding tool 2, whereby the edge of this opening is sloped corresponding to the front end 18 of the ignition tube 8, thus forming a contact surface 20.

The ignition tube 8 is located in its working position 10 in FIG. 2, and is pressing an edge area 19 of the workpiece 12 against the moulding tool 2. The edge area 19 is shaped in this process and clamped tightly between the two corresponding, conical contact surfaces 18, 20 of the ignition tube 8 and the moulding tool 2, consequently forming a workpiece holding area 21. In this way, the intake area 15 of the tool 1 is simultaneously closed in a gas-tight manner.

The ignition tube 8 in this embodiment has a valve 28 via which the intake area 15 in the interior of the moulding tool 2 or the workpiece cavity 13 can be filled with liquid. For more rapid filling, a multiple number of valves can also alternatively be provided.

FIG. 3 shows a cut through the tool arrangement 1 according to the invention, with an inserted workpiece 12. The reference numbers used in FIG. 3 indicate the same parts as in FIGS. 1 and 2, so that reference is made to the description of FIGS. 1 and 2 in this regard.

The intake area 15 of the moulding tool 2 extends through the workpiece cavity 13 in this embodiment. The intake area 15 and the workpiece cavity 13 are filled roughly three-fourths full with a liquid 26 in FIG. 3. Water, but also certain oils, can be considered as suitable liquids. An explosive gas mixture 23 is located above the surface of the liquid 22. The gas molecules are distributed in the available liquid-free area 24. Depending on the type of gas, some gas molecules also lie directly on the surface of the liquid 22.

In this embodiment, the explosive gas mixture 23 is a detonating gas. This can consist of a hydrogen (H.sub.2)-oxygen (O.sub.2) mixture or also of a hydrogen (H.sub.2)-air mixture. In other embodiments of the invention, other gases, such as nitrogen, for example, can also selectively be added to the gas mixture, depending on the particular application. The detonating gas used here is a stoichiometric gas mixture with a slight hydrogen excess. The hydrogen content here can lie in the range of from roughly 4 to 76%. Alternatively, however, another explosive gas mixture could also be used.

A connection 25 for introducing the explosive gas mixture and an ignition device 27 for igniting the explosive gas mixture are also provided in the ignition tube 8. Alternatively, a multiple number of gas connections 25, e.g., one for each type of gas, can also be provided in the ignition tube 8. In a further embodiment of the invention, however, it is also possible to provide one or more gas connections 25 in the moulding tool 2, as shown in FIG. 4.

FIG. 4 shows a cut through a tool arrangement 1 according to the invention in accordance with a second embodiment of the invention. The reference numbers used in FIG. 4 indicate the same parts as in FIGS. 1 to 3, so that reference is made to the description for FIGS. 1 to 3 in this regard.

In FIG. 4, the intake area 15 or the workpiece cavity 13 is completely filled with the liquid. The explosive gas mixture 23 here is again located above the surface of the liquid 22. The gas connection 25 is located below the surface of the liquid 22 in this embodiment. It is arranged here in one of the moulding tool halves 4.

FIG. 5 shows a cut through the tool arrangement 1 according to the invention as shown in FIG. 4, but with a changed liquid level. The reference numbers used in FIG. 5 indicate the same parts as in FIGS. 1 to 4, so that reference is made to the description of FIGS. 1 to 4 in this regard.

The workpiece cavity 13 here is completely filled with liquid 26. The workpiece holding area 21 is also covered by the liquid. This has the advantage that the interfaces or contact points that lie in this area, e.g., the interface between the workpiece 12 and the moulding tool 2, but also the interface between the workpiece 12 and the ignition tube 8, can be formed in such a way as to be liquid-tight. As a result, e.g., the design configuration of these interface areas can be simplified, or the contact force of the ignition tube 8 can be reduced. The explosive gas mixture 23 here is also located above the surface of the liquid 22, namely in the remaining liquid-free cavity 24, which lies completely within the ignition tube 8 with the liquid level shown. This means that the explosive gas mixture 23 or the cavity 24 in which it is located is positioned at a distance from the workpiece 12 given a liquid level of this height.

In the following, the functioning of the inventive embodiments described in FIGS. 1 to 5 is explained.

To insert the workpiece 12 into the moulding tool 2, the ignition tube 8 is located in its parked position 11. The moulding tool 2 is opened by means of at least one of the moulding tool halves 4 being moved to some distance away from the other moulding tool halves. The workpiece 12 is then introduced into the intake area 15 of the moulding tool 2. After this, the moulding tool 2 is closed again by means of all moulding tool halves 4 of the moulding tool 2 being joined together. The edge area 19 of the workpiece 12 here extends into the opening 17 of the moulding tool 2, as can be seen in FIG. 2.

The ignition tube 8 is subsequently moved along its longitudinal direction 9 from the parked position 11 and into the working position 10. In this process, the front, conical end 18 of the ignition tube 8 comes into contact with the edge area 19 of the workpiece 12 and forms this into a workpiece holding area 21 until it lies on the conical contact surface 20 of the moulding tool 2. Corresponding to the respective production requirements, the ignition tube 8 presses the workpiece holding area 21 against the contact surface 20 with a predetermined force. This can lead to an additional forming of the workpiece holding area 21, as shown in FIG. 3. As a result of the workpiece holding area 21 being pressed between the ignition tube 8 and the moulding tool 2, the intake area 15 is simultaneously sealed in a gas-tight manner.

The intake area 15, which roughly corresponds to the workpiece cavity 13 in the embodiments shown here, is filled with a certain quantity of liquid 26, for example, water, via the valve 28 in the ignition tube 8. The liquid 26 collects in the workpiece cavity 13 and forms a surface of the liquid 22.

The remaining, liquid-free cavity 24 is filled with a certain quantity of the explosive gas mixture 23 via the gas connection 25 in the ignition tube 8. The ratio of explosive gas to liquid here is in the range of from 1:1 to 1:20. Gas-liquid ratios in the range of from 1:2 to 1:15 have proven to be advantageous, whereby a ratio in the range of from 1:3 to 1:10 is especially favourable. In particular, a gas-liquid ratio of 1:7 should be sought. The gas pressure before the explosive forming is in the range of from approximately 60 to 200 bar, advantageously in the range of from 70 to 120 bar and particularly in the range of from 95 to 105 bar, or 110 to 130 bar.

The quantity of liquid or the liquid level can be varied as shown in the FIGS. 3 to 5. Depending on the liquid level, the volume here changes, as does the position of the remaining liquid-free cavity 24. As a result of the relatively low liquid level in FIG. 3, the cavity 24 or the gas mixture 23 extends, for example, from the workpiece cavity 13 across the workpiece holding area 21 and into the ignition tube 8. In FIG. 4, e.g., the entire intake area 15 is filled with liquid 26. The explosive gas mixture 23 or the remaining liquid-free cavity 24 here extends only in the workpiece holding area 21 and into the ignition tube 8. In FIG. 5, on the other hand, the liquid-free cavity 24 is only still found in the ignition tube 8, and so is spaced at a distance from the workpiece 12. The volume of the free cavity 24 can lie in a range of from roughly one-half liter to ten liters. Cavities 24 with a volume of approximately one-half to four liters have proven to be advantageous in practice, whereby a cavity volume of approximately one to two liters is especially economical.

The explosive gas mixture 23, which is located in the cavity 24, is ignited by activation of the ignition device 27. With the detonating gas used in this embodiment of the invention, the existing oxygen is roughly completely burned or converted during the explosion. This should counteract corrosion of the workpiece and the tool or the entire system. To be considered as ignition mechanisms here are fundamentally the common ignition mechanisms known, e.g., from the state of the art.

The resulting detonation front propagates initially in the gas mixture 23 or the cavity 24 and then reaches the phase interface, namely the surface of the liquid 22. During this process, roughly four-fifths of the energy or the force of the detonation front is transmitted to the liquid. The direct contact between the gas mixture 23 and the liquid 26, without additional components in between, guarantees relatively good power transmission. The pressure wave passed on to the liquid 26 continues into this liquid, consequently pressing the workpiece 12 into the cavity 14 of the moulding tool 2. At the same time, the workpiece holding area 21 is separated from the remaining shaped workpiece 12 by means of the separating edge 29 provided in the moulding tool 2. The forming pressure achieved in this way is approximately 2,000 to 2,500 bar when the quantity of gas that is filled in is approximately 1 liter in this embodiment and the starting pressure prevailing here is approximately 100 bar.

During this process, the liquid 26 covers large portions of the workpiece 12, depending on the liquid level, and protects these portions from burns. If cutting or separating edges 29 are provided in the moulding tool 4 in order simultaneously also to cut the workpiece 12 to size during the forming, the quality of these edges is improved by means of the pressure transmission using liquid. The edge quality of holes that can be stamped in during the forming is also improved. A further advantage of the liquid filling is the simplification of the interfaces in the workpiece holding area 21 and/or between the individual moulding tool halves 4. As shown in FIGS. 3 to 5, here these lie below the surface of the liquid 22 and are therefore only liquid-tight. As a result of the liquid filling, it is also possible to reduce the necessary quantity of gas in comparison to explosive forming without a liquid filling. In order to achieve explosive forming of the workpiece in the embodiment shown here with a pure gas filling, roughly three liters of the explosive gas mixture 23 would be required. With the liquid filling 26 shown here, the necessary gas quantity can be reduced to approximately one liter. The forming result achieved in this process is roughly equivalent, and often displays even better quality.

In the embodiment described above, the liquid is filled in via a valve 28 in the ignition tube 8, because this is an approximately straight, tube-shaped workpiece 12. Alternatively, the liquid can, however, also be filled into the moulding tool cavity 13 by means of an immersion bath. This is particularly suitable for workpieces that, because of their shape, are suitable for taking in liquid, e.g., for workpieces with a curved or tub-like shape. Such workpieces can, e.g., be preformed from bar stock and then conveyed into a liquid bath, for example, a water bath. Here, they are then submerged into this bath, depending on the desired quantity of liquid, before being inserted into the moulding tool 2. Such a liquid bath can simultaneously serve, e.g., as a production buffer, in which a certain number of pre-formed and liquid-filled workpieces 12 are temporarily stored before being inserted into the moulding tool 2.

The filling with the gas mixture 23 also does not necessarily have to take place via one or more connections 25 in the ignition tube 8. According to the second embodiment of the invention, the gas mixture 23 can also be introduced below the surface of the liquid, e.g., by means of one or more gas connections 25 in the moulding tool 2, as shown in FIG. 4. In this case, the gas 23 introduced below the surface of the liquid rises through the liquid 26 and collects in the liquid-free cavity 24.

The ignition here also takes place by means of the ignition device 27. Depending on the production cycle and desired forming result, the ignition can take place after all of the gas 23 has collected in the cavity 24 or earlier, when at least a portion of the gas mixture 23 is still located in the liquid 26.

The introduction of the gas 23 through a liquid 26, for example, through water, has the advantage that a higher forming pressure can be achieved without increasing the quantity of gas. Depending on the workpiece and quantity of gas and liquid filled in, an increase in the forming pressure of up to four times is possible in such a way.

The tool arrangement and method according to the invention were described here using a roughly tube-shaped workpiece 12 and a corresponding moulding tool 2. Nevertheless, other workpiece shapes and accordingly moulding tools with other shapes are also possible. For example, it is also possible to form relatively flat or curved workpieces with the tool arrangement and method described here. Workpieces and moulding tools are also possible that, unlike the embodiments shown here, have more than one workpiece holding area.

Although water is used as the filling and pressure transmission medium in the tool arrangement and method described here, in principle, other fluids can also be used for this purpose in the inventive method. Liquids that are particularly suitable for this purpose because of their viscosity ranges, e.g., certain oils, would be conceivable here.

The mould cavity 13 is filled with liquid in the method described above. This is particularly suitable for tube-shaped workpieces and has proven to be advantageous in practice. In other embodiments of the invention, the liquid can, however, also be located in the intake area 15 outside of the workpiece cavity 13.

The invention claimed is:

1. A method for explosive forming of a work piece (12) having an interior by means of a gas explosion, comprising: arranging the work piece (12), including a work piece holding area (21), in an intake area (15) of a moulding tool (2); at least partially filling a work piece cavity (13), whose wall has a closed shape in cross-section, with liquid (26), providing in an ignition tube (8) an explosive gas mixture (23) in direct fluid communication with a surface of the liquid (22) prior to ignition, wherein the ignition tube (8) and the work piece (12) together form a sealed path having a substantially constant cross-section; and wherein the ignition tube (8) is brought into abutment with the work piece holding area (21) prior to triggering the explosion, triggering the explosion by igniting the explosive gas mixture (23) in the ignition tube (8) in order to form a detonation front propagating through the ignition tube and into the interior of the work piece (12).

2. A method according to claim 1, wherein the work piece cavity (13) has a cross-section, and the ignition tube (8) has an interior having a cross-section that is substantially the same as the cross-section of the work piece cavity (13).

3. A method according to claim 2, wherein the moulding tool (2) includes a mould cavity (14) that includes separating edges (29) and the explosion causes the work piece (12) to be pressed against the mold cavity such that the work piece holding area (21) is separated from the rest of the work piece (19) by engagement with the separating edges (29).

4. A method for explosive forming of a work piece (12) having an interior by means of a gas explosion, comprising: arranging the work piece (12) in an intake area (15) of a moulding tool (2); at least partially filling a work piece cavity (13), whose wall has a closed shape in cross-section, with liquid (26), providing in an ignition tube (8) an explosive gas mixture (23) in direct fluid communication with a surface of the liquid (22) prior to ignition, wherein the ignition tube (8) and the work piece (12) together form a sealed path having a substantially constant cross-section; triggering the explosion by igniting the explosive gas mixture (23) in the ignition tube (8) in order to form a detonation front propagating through the ignition tube and into the interior of the work piece (12), wherein the gas mixture (23) is at least partially introduced through the liquid (26).

5. A method according to claim 1, wherein the surface of the liquid (26) is in the ignition tube (8).

6. A method for explosive forming of a work piece (12) having an interior by means of a gas explosion, comprising: arranging the work piece (12) in an intake area (15) of a moulding tool (2); at least partially filling a work piece cavity (13), whose wall has a closed shape in cross-section, with liquid (26), providing in an ignition tube (8) an explosive gas mixture (23) in direct fluid communication with a surface of the liquid (22) prior to ignition, wherein the ignition tube (8) and the work piece (12) together form a sealed path having a substantially constant cross-section; triggering the explosion by igniting the explosive gas mixture (23) in the ignition tube (8) in order to form a detonation front propagating through the ignition tube and into the interior of the work piece (12) wherein the gas mixture (23) is a substantially stoichiometric ratio of hydrogen and oxygen at a pressure in the range of 60 to 200 bar prior to ignition and the ratio of the gas mixture (23) to liquid (26) is in the range of 1:1 to 1:20.

7. A method according to claim 1, wherein the detonation front generates a traveling shock wave that has a length shorter than a longitudinal length of the work piece and wherein, in operation, the shock wave applies a localized pressure to the work piece in a direction that is transverse to a direction of the shock wave.

8. A method according to claim 6, wherein the detonation front generates a traveling shock wave that has a length shorter than the longitudinal length of the work piece and wherein, in operation, the shock wave applies a localized pressure to the work piece in a direction that is transverse to the direction of the shock wave.

9. A method according to claim 6, further including the step of providing each of said ignition tube and said molding tool with a corresponding contact surface, each having a shape.

10. A method according to claim 9, further including the step of clamping said workpiece between said molding tool and said ignition tube.

11. A method according to claim 9, wherein said step of clamping said workpiece between said molding tool and said ignition tube further includes the step of clamping the workpiece between the contact surface of the molding tool and the contact surface of the ignition tube.

12. A method according to claim 4, wherein the surface of the liquid (26) is in the ignition tube (8).

13. A method according to claim 6, wherein the surface of the liquid (26) is in the ignition tube (8).

14. A method according to claim 4, wherein the detonation front generates a traveling shock wave that has a length shorter than a longitudinal length of the work piece and wherein, in operation, the shock wave applies a localized pressure to the work piece in a direction that is transverse to a direction of the shock wave.

15. A method according to claim 6, wherein the detonation front generates a traveling shock wave that has a length shorter than a longitudinal length of the work piece and wherein, in operation, the shock wave applies a localized pressure to the work piece in a direction that is transverse to a direction of the shock wave.

* * * * *